US005549261A

United States Patent [19]

Hardin

[11] Patent Number: 5,549,261

[45] Date of Patent: Aug. 27, 1996

[54] LADDER BRACING FOR GUTTERS

[76] Inventor: Bert A. Hardin, 7740 Glen Devon Rd., Jonesboro, Ga. 302236

[21] Appl. No.: 332,802

[22] Filed: Nov. 2, 1994

[51] Int. Cl.[6] ..... E04D 13/072

[52] U.S. Cl. ..... 248/48.2; 248/48.1

[58] Field of Search ..... 52/11, 12; 248/48.2, 248/48.1

[56] References Cited

U.S. PATENT DOCUMENTS

| | | | |
|---|---|---|---|
| 2,761,,642 | 9/1956 | Rachlin | 248/48.1 |
| 2,928,634 | 3/1960 | Bender | 248/48.2 |
| 3,060,638 | 10/1962 | Bender | 52/11 |
| 3,340,653 | 9/1967 | Steeg | 248/48.2 |
| 3,909,905 | 10/1975 | Giordano | 52/11 |
| 4,185,421 | 1/1980 | Robinson | 52/11 |
| 5,098,223 | 3/1992 | Schoenherr | 248/48.1 |

*Primary Examiner*—Karen J. Chotkowski
*Assistant Examiner*—Gwendolyn Wrenn-Baxter
*Attorney, Agent, or Firm*—Watson Cole Stevens Davis, P.L.L.C.

[57] ABSTRACT

A brace for a gutter including a support which is sized and shaped to fit within a gutter, at least two ferrules and at least one fastener for each ferrule. The at least two ferrules being of a larger inner diameter than an outer diameter of said at least one fastener. The support contains at least two sets of holes, each set of holes being defined in said support. One hole is of a first size such that a fastener can pass through it but a ferrule cannot and the other hole is of a second size that both a fastener and a ferrule can pass through. The holes are parallel to each other and the centers of the holes are opposite each other. The ferrule is inserted into said hole of first size allowing the ferrule to pass through it. The fastener is inserted into the hole of second size and passes through the support into the hole of first size and through the ferrule.

9 Claims, 3 Drawing Sheets

LADDER BRACING FOR GUTTERS

The present invention relates to a means for bracing gutters and protecting them from being damaged when a ladder or other device is leaned against them to allow access to upper portions of a structure, including but not limited to the roof of a single family home or set of townhouses.

BACKGROUND OF THE INVENTION

Most houses built in the United States today include gutters, which are secured to the fascia board of the structure, usually just below the roof line. These gutters are necessary to protect the siding or paint on the structure from damage from rain, snow and the like by catching the rain, snow and the like and causing it to flow to down spouts and away from the building with minimal contact with the front, back and sides of the house. The construction of gutters and the placement thereof against the fascia board of a structure is well known in the art. As is well known in the art, gutters are generally made of a thin sheet of aluminum or plastic, which are light in weight.

The presence of thin aluminum or plastic gutters along the fascia board of a structure is a source of difficulty when one needs to access the roof or upper portions of the structure. Usually, a ladder is placed and supported against the structure, and the worker or homeowner climbs the ladder to access, for example, the roof. However, since the gutters must stick out beyond the lower roof line to be effective in trapping rain and the like, the ladder must be placed against the gutters. As is well known to those skilled in the art, aluminum gutters cannot withstand much pressure before bending. Therefore, pressure of a ladder with a person climbing it will easily bend a conventional gutter. Thus, when placing a ladder against a house, one must carefully and exactingly evaluate the location and angle of the ladder to avoid placing pressure on the gutter, thereby avoiding bending the gutter.

U.S. Pat. No. 4,185,421, to Robinson, relates to a gutter protector assembly. However, the protection desired by Robinson is to prevent slippage of the ladder while in use. The H-shaped structure of the device of Robinson is secured to the fascia board of the house, directing the load of the ladder directly to the fascia board, and prohibiting any part of the load frown being transferred to the gutter. Such a protector is entirely different frown that of the present invention, as discussed below.

BRIEF SUMMARY OF THE INVENTION

One object of the present invention is to provide means for bracing a gutter from the weight of a ladder and ladder user.

A second object of the present invention is to provide a sturdier gutter.

A third object of the present invention is provide a method of bracing a gutter.

These objects and others which will be clear to one skilled in the art will be clear from the present invention, which is directed to a gutter brace which comprises a support which is sized and shaped to fit within a gutter, at least two ferrules and at least one fastener for each ferrule; said at least two ferrules being of a larger inner diameter than an outer diameter of said at least one fastener; the support containing at least two sets of holes, each set of holes being defined in said support, one hole which is of a first size such that a fastener can pass through it but a ferrule cannot and the other hole being of a second size such that both a fastener and a ferrule can pass through; said holes being concentric with each but positioned on opposite ends of the support said ferrule being inserted into said hole of a second size allowing the ferrule to pass through it, said fastener being inserted into the hole of said first size and passing through said support, said ferrule end said hole of said second size.

DETAILED DESCRIPTION OF THE INVENTION

Figure 1:
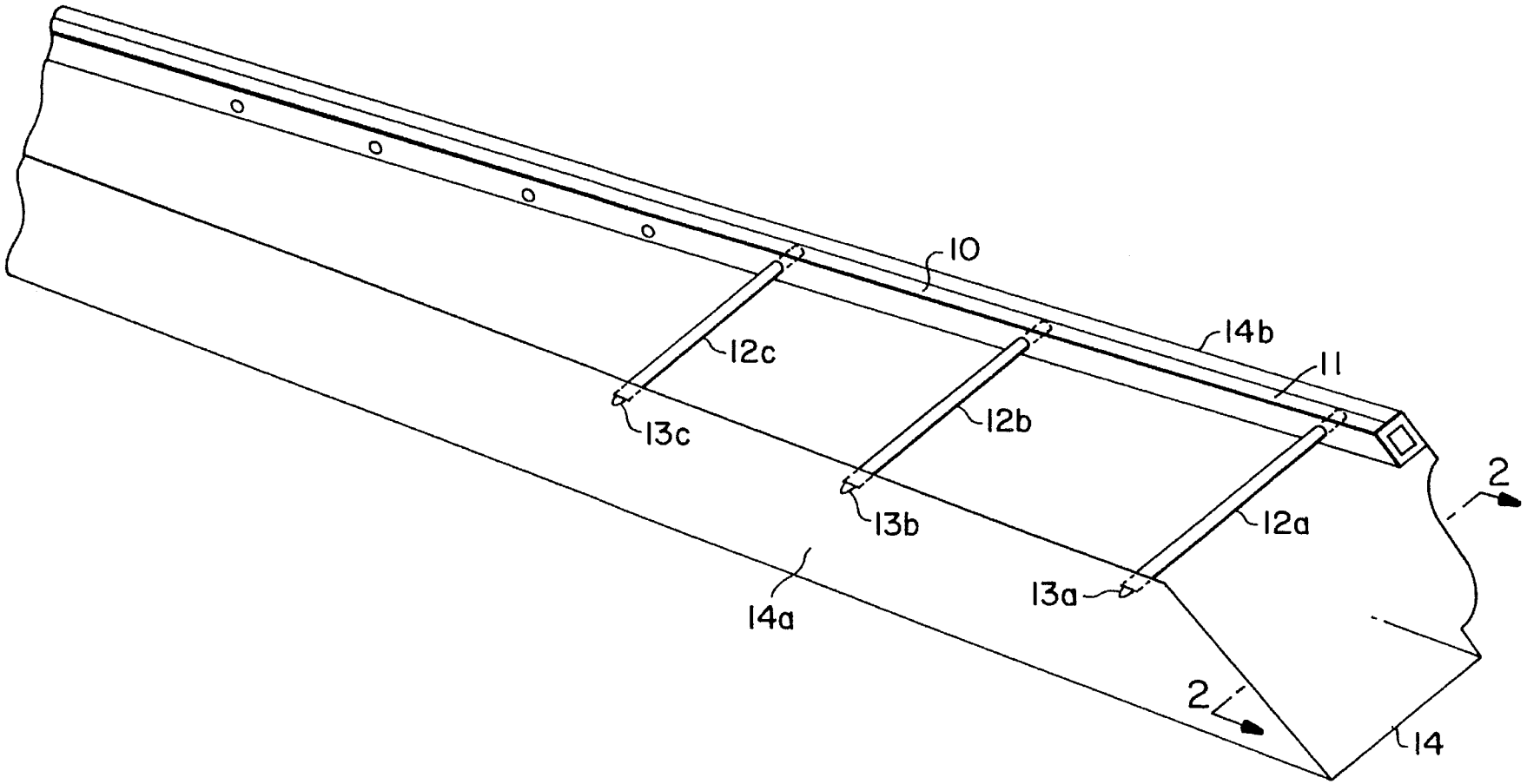
FIG. 1 is a perspective view of the present invention installed in a gutter.

The brace of the present invention is designated generally by the reference numeral 10 in the drawings. FIG. 1 shows a gutter 14 in which the brace 10 of the present invention has been installed. The manner in which the brace 10 is installed in a gutter 14 will be clear to one skilled in the art from this disclosure. In FIG. 1, 14*a* indicates the side of the gutter 14 which is in contact with the side of the fascia 17 of a building.

The brace 10 comprises a support structure (such as tubing 11), ferrules 12*a*–12*c* and fasteners 13*a*–13*c* (such as but not limited to spikes, as shown in the drawings and referred to hereinafter, helically threaded nails and screws). In the remaining discussion, ferrule 12*a* and spike 13*a* are discussed but it is understood that the same discussion is applicable to the other ferrules and spikes in the present invention. The tubing 11 can be ⅛" thick and the thickness thereof is determined based on the size of the gutter 14 in which it is being installed. The cross section of the tubing 11 can be any rigid shape, including box or rectangular shaped (as shown in the drawings), ∩-shaped, N-shaped, round and flat. In FIG. 1, the tubing 11 runs the entire length of the gutter 14, but only 3 ferrules (12*a*–*c*) and spikes (13*a*–*c*) are shown. In practical use, when the tubing 11 is installed over the entire length of the gutter 14, ferrules and spikes will also be present over the entire length of the gutter 14. The remaining ferrules and spikes will be identical to ferrules 12*a*–*c* and spikes 13*a*–*c*, respectively. Alternatively, the support structure can be solid in cross-section.

As shown in FIG. 1, tubing 11 is placed inside the gutter 14 on the side of the gutter adjacent to 14*b*. The tubing 11 is predrilled for easy application and for ensuring maximum structural integrity and strength. The holes for the ferrules 12 and the spikes 13 are drilled so as to create a counter supporting and locking effect (FIG. 1 ) in the brace 10.

Figure 3:
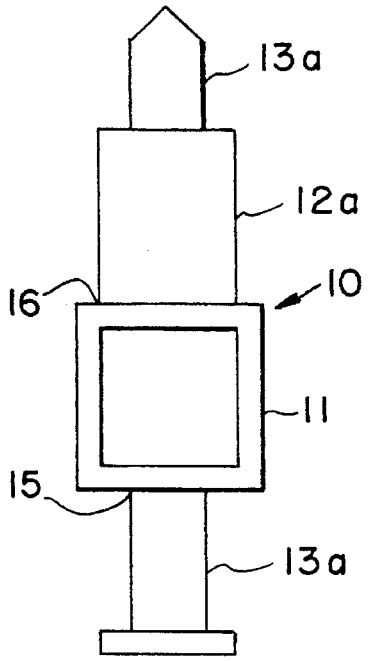
FIG. 3 is view of the components of the present invention assembled but not installed into a gutter.

The spikes 13 are standard ones available at most hardware stores and has a diameter smaller than the diameter of the ferrules 12. Preferably, the spikes 13 are of ¼" diameter. The ferrules are hollow to allow the spikes 13 to pass through and are preferably of a diameter of ½". The spikes 13 must be longer than the width of the gutter 14, as shown in FIG. 1. The spikes 13 must also be longer than the combination of the tubing size 11 and the length of the ferrule 12, as shown in FIG. 3, since, in use, the spike 13 is placed through holes.

Figure 2:
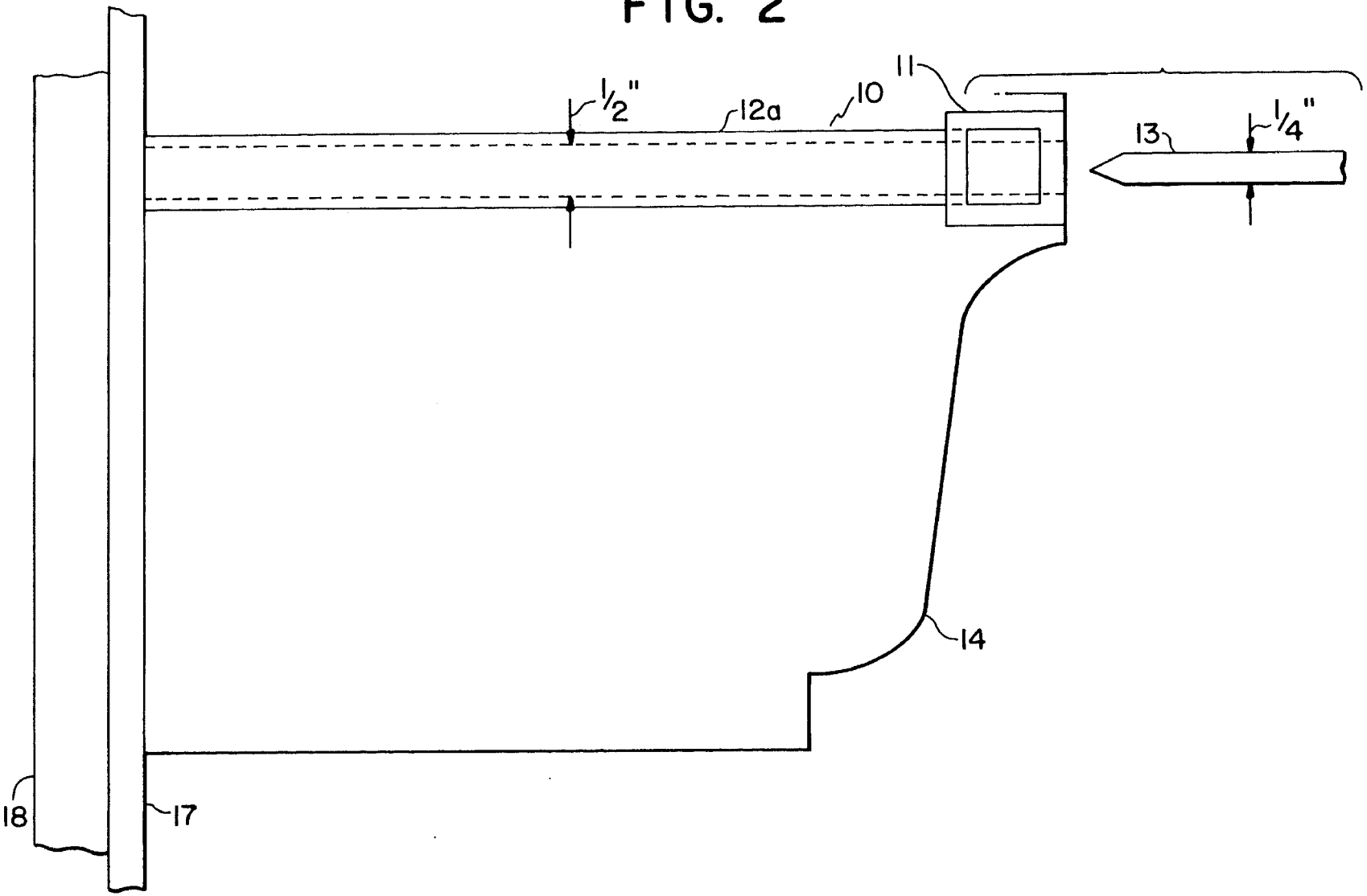
FIG. 2 is a side view taken along the 2—2 line of FIG. 1.
Figure 4:
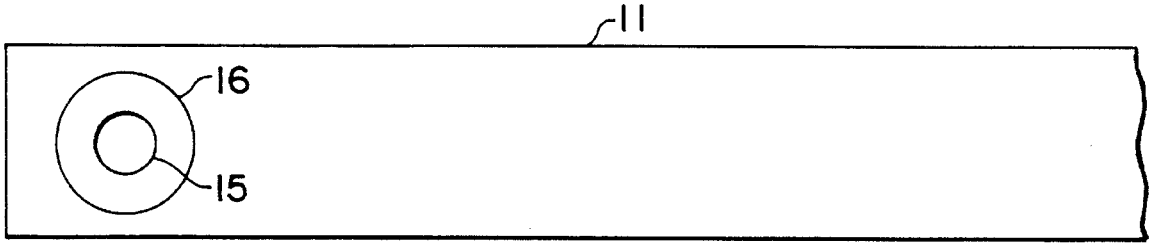
FIG. 4 is a side view of the tubing of the present invention.

As shown in FIG. 4, two holes 15 and 16 are drilled in the tubing 11 for each set of a spike 13 and a ferrule 12. Hole 15 is on the side of the tubing 11 which is farther from the building and is against the gutter 14 and is of a size through which the spike 13 will pass but the ferrule 12 will not. Hole 16 is on the side of the tubing 11 which is closer to the building and not in contact with the gutter 14 and is of a size that both the spike 13 and the ferrule 12 can pass through. Preferably hole 16 in the tubing 11 is approximately just large enough to permit entry of ferrule 12. Holes (not shown) are also placed near the top of both sides of the gutter 14 to correspond in size and location to holes 15. When the brace 10 is installed in a gutter 14, the holes 15 and 16 in the tubing 11 allow the spike 13 to pass entirely through the gutter and be secured to the fascia board 17 in a manner which would be clear to one skilled in the art. After passing through the outer edge of the gutter 14 and the tubing 11, the spike 13 is run though the ferrule 12, as shown in the drawings, particularly FIGS. 2 and 3, then through the other side of the gutter 14*a* and into the structure. The ferrule 12 is thus secured along the spike 13 within the gutter 14 and provides additional support and bracing to the gutter 14.

The tubing 11 can run the entire length of the gutter 14, as shown in FIG. 1, or a smaller length of tubing 11 can be placed along a small portion of the gutter 14. If it is desired to place the tubing 11 only in a small portion of the gutter 14, (thus limiting access to the roof, as discussed below) a 34" length of tubing 11 would be appropriate since the standard ladder width is 18". The tubing material is available in 21' sections for total gutter applications.

The brace 10 increases the weight capacity that the gutter 14 can withstand without bending or the like, allowing a ladder (not shown) to be leaned against it and climbed without damage to the gutter 14. If the bracing 10 is placed over the entire length of the gutter 14, the homeowner or worker can place a ladder and access the roof and other upper portions of the structure along any portion of the gutter 14 without fear of damage to the gutter. If the bracing 10 is placed only along a selected portion of the gutter 14, it is preferred to indicate the ends of the bracing on the outside of the gutter 14, for example by red paint (not shown) to allow the homeowner or worker quick identification of the portion of the gutter which is braced.

In most areas, building codes require that structures be built on centers, for example 16" centers. Therefore, the holes for the ferrules 12 and spikes 13 will also be placed on 16" centers to allow the spikes 12 to be secured to a structural support 18 such as a stud. If the building codes are different and/or the structure is built on different centers, the distance between the holes for the ferrules 12 and spikes 13 will be changed accordingly. Since the brace 10 is preferably placed in the gutter 14 prior to installation, it would be simple for the tubing 11 and gutter 14 to be predrilled for the appropriate application. If the bracing 10 is to be added to existing gutters, the gutters must be removed for installation.

What is claimed:

1. A brace for a gutter comprising:

a support having opposite sides adapted to fit within a gutter, at least two ferrules and one fastener for each ferrule, said fastener having an outer diameter; said at least two ferrules each having an inner and outer diameter wherein the inner diameter is larger than the outer diameter of said fastener;

the support containing at least two sets of holes, each said set of holes being defined in said support, one of said holes is of a first size greater than the outer diameter of the fastener and less than the outer diameter of the ferrule such that the fastener can pass therethrough, but one of said ferrules cannot and the other of said holes being of a second size greater than the outer diameters of both the fastener and the ferrule such that both the fastener and the ferrule can pass through; said holes being concentric to each other and positioned on opposite sides of said support;

said ferrule being inserted into said hole of said second size and seated against a portion of said support surrounding said first hole, said fastener being inserted into the hole of said first size and passing through said support, said ferrule and said hole of second size.

2. The brace of claim 1, wherein the support is rectangular tubing.

3. The brace of claim 2, wherein the tubing is aluminum.

4. The brace of claim 1, wherein the fasteners are spikes.

5. The brace of claim 4, wherein the spikes have a diameter of ¼".

6. The brace of claim 1, wherein the ferrules have an interior diameter of ½".

7. The brace of claim 1 comprising in combination a gutter wherein the brace is installed within said gutter.

8. A method of bracing a gutter having opposite sides comprising placing a support which is adapted to fit within a gutter within said gutter, said support being parallel to and in contact with a side of the gutter which is opposed to a fascia board, said support defining at least two sets of holes, each set of holes comprising at least a first and second hole of different size concentric with each other; said gutter defining two holes in opposite sides of said gutter in alignment with said first hole of said support;

placing a ferrule having an inner and outer diameter into said second hole, said second hole having a size greater than the outer diameter of the ferrule and greater than the outer diameter of the fastener such that the ferrule and the fastener can pass through, said first hole having a size less than the outer diameter of the ferrule and greater than the outer diameter of the fastener so that only the fastener can pass through:

placing the fastener through each hole in one side of said gutter into said first hole, aligned therewith, through the ferrule, said second hole of said support and opposing hole in said gutter; and securing the gutter to the fascia board by passing the fastener into the fascia board.

9. The method of claim 8, wherein the step of securing the gutter to the fascia board comprises locating a structural support behind the fascia board and securing the gutter to the fascia board by passing the fasteners through the fascia board and into the structural support.

* * * * *